US006484696B2

(12) United States Patent
Barnes et al.

(10) Patent No.: US 6,484,696 B2
(45) Date of Patent: Nov. 26, 2002

(54) MODEL BASED RAIL PRESSURE CONTROL FOR VARIABLE DISPLACEMENT PUMPS

(75) Inventors: Travis E. Barnes, Metamora, IL (US); Michael S. Lukich, Chillicothe, IL (US); David Milam, Bloomington, IL (US); George M. Matta, Washington, IL (US); Douglas E. Handly, Morton, IL (US); Denis El Darazi, Peoria, IL (US); Meixing Lu, Peoria, IL (US); Nolan W. Wartick, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/825,407

(22) Filed: Apr. 3, 2001

(65) Prior Publication Data

US 2002/0139350 A1 Oct. 3, 2002

(51) Int. Cl.[7] ..... F02M 37/04
(52) U.S. Cl. ..... 123/446; 123/494
(58) Field of Search ..... 123/446, 494; 60/445, 449, 452

(56) References Cited

U.S. PATENT DOCUMENTS 5,357,912 A 10/1994 Barnes et al.
5,485,820 A 1/1996 Iwaszkiewicz
5,603,609 A 2/1997 Kadlicko
5,634,448 A 6/1997 Shinogle et al.
5,653,210 A 8/1997 Fischer et al.
5,957,111 A * 9/1999 Rodier ..... 123/446
6,035,828 A 3/2000 Anderson et al.
6,237,567 B1 * 5/2001 Nakana et al. ..... 123/446

OTHER PUBLICATIONS

English Language translation of "Heavy Duty Diesel Engines —The Potential of Injection Rate Shaping for Optimizing Emissions and Fuel Consumption", presented by Messrs. Bernd Mahr, Manfred Durnholz, Wilhelm Polach, and Hermann Grieshaber, Robert Bosch GmbH, Stuttgart, Germany, at the 21st International Engine Symposium, May 4–5, 2000, Vienna, Austria.

Robert Bosch GmbH, Diesel–Engine management, pp. 266–271, Stuttgart, Germany.

* cited by examiner

*Primary Examiner*—Thomas N. Moulis
(74) *Attorney, Agent, or Firm*—Liell & McNeil

(57) ABSTRACT

A method of controlling a hydraulic system is preferably applied to common rail fuel injection systems. The problem in these systems is to control pressure in the common rail while at the same time maintaining the fluid supply to the rail in a way that precisely meets the dynamically changing consumption demands on the hydraulic system. In order to control the hydraulic system, the present invention contemplates the combination of a standard feedback controller with observer models of the various hardware items that make up the hydraulic system. Using this strategy, the system can generally be thought of as controlling fluid supply in an open loop type fashion based upon the consumption rates estimated by the various observer models, and utilizing a conventional feedback controller to make the slight pump adjustments needed to control pressure and to correct for any errors between the actual hardware performance and that predicted by the observer models.

20 Claims, 4 Drawing Sheets

MODEL BASED RAIL PRESSURE CONTROL FOR VARIABLE DISPLACEMENT PUMPS

TECHNICAL FIELD

The present invention relates generally to the control of hydraulic systems, and particularly to a model based pressure control strategy for a hydraulic system with a variable delivery pump.

BACKGROUND

Hydraulic systems, particularly those used in conjunction with an internal combustion engine, have been known for years. For example, Caterpillar Inc. of Peoria, Illinois has been successfully manufacturing and selling hydraulic fuel injection systems for many years. In the past, these systems typically included at least one common rail containing high pressure actuation fluid that was supplied to actuate a plurality of hydraulic devices such as hydraulically actuated fuel injectors and/or gas exchange valve actuators (engine brake, intake, exhaust). The high pressure common rail was supplied with pressurized actuation fluid by a fixed displacement pump. Control of pressure in the common rail was maintained by sizing the pump to always supply more than the needed amount of high pressure fluid and then utilizing a rail pressure control valve to spill a portion of the fluid in the common rail back to the low pressure reservoir. The control system strategy for these systems typically relied upon a feedback control loop in which the desired rail pressure was compared to the measured or estimated rail pressure, and the position of the rail pressure control valve was set as a function of the error signal generated by that comparison. A system of this type is illustrated, for example, in U.S. Pat. No. 5,357,912 to Barnes et al. While these hydraulic systems, and the control thereof, have performed magnificently for many years, there remains room for improvement.

One area in which these previous hydraulic systems could be improved is by decreasing the amount of pressurized actuation fluid that is spilled back to the low pressure reservoir without performing any useful work, such as actuating one of the hydraulic devices. In other words, energy is consumed and arguably wasted whenever the rail pressure control valve opened to allow pressurized fluid from the high pressure rail to leak back to the low pressure reservoir. In order to decrease the amount of energy consumed in controlling the pressure in the hydraulic system, one strategy has been to introduce a variable delivery pump and eliminate the previous rail pressure control valve. Such a hydraulic system is shown and described in co-owned U.S. Pat. No. 6,035,828 to Anderson et al. This system greatly reduces the amount of wasted energy since the pump is controlled to produce only the amount of actuation fluid necessary to maintain a desired rail pressure. Although this type of fluid supply and pressurization strategy has considerable promise, it still may suffer from at least one subtle drawback when it is controlled via a feedback loop based upon a comparison of the desired rail pressure to the actual rail pressure. Due at least in part to the fact that the fluid being consumed from the high pressure common rail can be rapidly and continuously changing, engineers have observed that the control system can be at least temporarily overwhelmed in this highly dynamic system. In other words, the system can sometimes demonstrate an inability to both maintain an adequate fluid supply to the hydraulic devices and do so at the desired pressure without unacceptable lags between the control system response and the fluid demands of the hydraulic devices.

The present invention is directed to these and other problems associated with hydraulic systems.

SUMMARY OF THE INVENTION

In one aspect, a method of controlling a hydraulic system includes at least some features of the previous control systems based upon a pressure error feedback control system. Thus, the method includes a step of generating a control variable at least in part by comparing a desired liquid pressure to an estimated liquid pressure. Next, the liquid consumption rate of the hydraulic system is estimated. Finally, the pump output rate is set as a function of the control variable and the estimated system consumption rate.

In another aspect, a method of controlling liquid pressure in a common rail hydraulic system for an engine includes a step of estimating engine speed, the viscosity of the liquid in the hydraulic system and the rail pressure of the hydraulic system. The injector consumption rate and the pump consumption rate are also estimated. A control rate is generated at least in part by comparing the desired rail pressure to the estimated rail pressure. Finally, the pump output rate is set as a function of the control rate plus the estimated injector consumption rate plus the estimated pump consumption rate.

In still another aspect, a common rail hydraulic system includes a variable delivery pump with an outlet. At least one hydraulic device has an inlet. A common rail has an inlet fluidly connected to the outlet of the variable delivery pump, and an outlet connected to the inlet of the at least one hydraulic device. A pump output controller is operably coupled to the variable delivery pump, and produces a pump control signal that is a function of a desired rail pressure, an estimated rail pressure and an estimated consumption rate of the hydraulic system.

DETAILED DESCRIPTION

Figure 1:
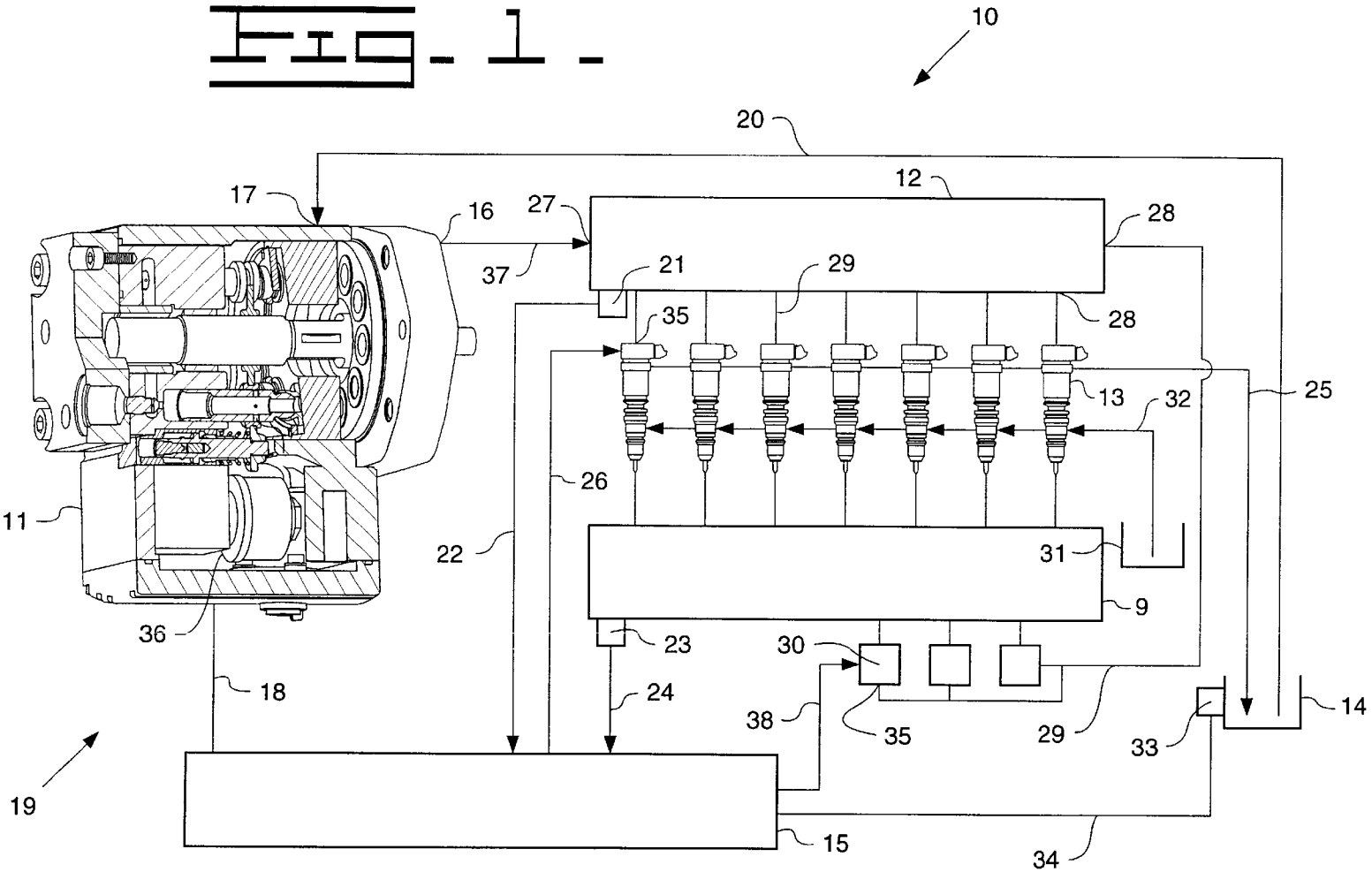
FIG. 1 is a schematic illustration of an engine and hydraulic system according to the preferred embodiment of the present invention.

Referring to FIG. 1, an internal combustion engine 9, which is preferably of the diesel type, includes a hydraulic system 10 that includes a pump 11, a high pressure common rail 12 and a plurality of hydraulic devices. Pump 11 can be any suitable variable delivery pump that is preferably a fixed displacement sleeve metered variable delivery axial piston pump of the type generally described in co-owned U.S. Pat. No. 6,035,828. Nevertheless, those skilled in the art will appreciated that any suitable variable delivery pump, such as a variable angle swash plate type pump whose output is controlled via an electrical signal, could be substituted for the illustrated pump without departing from the intended scope of the present invention. The hydraulic system includes a plurality of hydraulic devices, which preferably include a plurality of fuel injectors 13, and might also include a plurality of gas exchange valve actuators 30, such as engine brake actuators, exhaust valve actuators and/or intake valve actuators.

Fuel injectors 13 are preferably hydraulically actuated fuel injectors of the type manufactured by Caterpillar Inc. of Peoria, Illinois, but could be any suitable common rail type fuel injector including but not limited to pump and line common rail fuel injectors, or possibly a Bosch type common rail fuel injector of the type described in "Heavy Duty Diesel Engines—The Potential of Injection Rate Shaping for Optimizing Emissions and Fuel Consumption", presented by Messrs Bernd Mahr, Manfred Dürnholz, Wilhelm Polach, and Hermann Grieshaber, Robert Bosch GmbH, Stuttgart, Germany at the 21st International Engine Symposium, May 4–5, 2000, Vienna, Austria. In the illustrated preferred embodiment, the hydraulic system 10 utilizes lubricating oil, but those skilled in the art will appreciate that any other fluid could be used, such as diesel fuel (Bosch), depending upon the nature and structure of the hydraulic devices.

In the preferred embodiment illustrated, variable delivery pump 11 includes an inlet 17 connected to a low pressure reservoir/oil pan via a low pressure supply line 20. An outlet 16 of variable delivery pump 11 is fluidly connected to an inlet 27 of high pressure common rail 12 via a high pressure supply line 37. Common rail 12 includes a plurality of outlets 28 that are fluidly connected to device inlets 35 via a plurality of high pressure supply lines 29. After being used by the respective hydraulic device (fuel injectors 13 and gas exchange valve actuators 30) the used oil returns to low pressure reservoir 14 via an oil return line 25 for recirculation. The system also includes, in this example embodiment, a fuel tank 31 that is fluidly connected to fuel injectors 13 via a fuel supply line, which is preferably at a relatively low pressure relative to that in high pressure common rail 12.

In order to control hydraulic system 10 and the operation of engine 9, an electronic control module receives various sensor inputs, and uses those sensor inputs and other data to generate control signals, usually in the form of a control current level or control signal time, to control the various devices, including the variable delivery pump 11, fuel injectors 13 and gas exchange valve actuators 30. In particular, a pressure sensor 21 senses pressure somewhere in hydraulic system 10, preferably at high pressure common rail 12, and communicates a pressure signal to electronic control module 15 via a sensor communication line 22. Electronic control module then uses that sensor signal to estimate the pressure in common rail 12. A speed sensor 23, which is suitably located on engine 9, communicates a sensed speed signal to electronic control module 15 via a sensor communication line 24. The electronic control module 15 uses this signal to periodically update its estimate of the engine speed. A temperature sensor 33, which can be located at any suitable location in hydraulic system 10 but preferably in rail 12, communicates an oil temperature sensor signal to electronic control module 15 via a sensor communication line 34. Like the other sensors, electronic control module 15 uses the signal to estimate the oil temperature in hydraulic system 10. The electronic control module preferably combines the temperature estimate with other data, such as an estimate of the grade of the oil in hydraulic system 10, to generate a viscosity estimate for the oil. Those skilled in the art will appreciate that viscosity estimates can be gained by other means, such as by pressure drop sensors, viscosity sensors, etc. Electronic control module 15 controls the activity of fuel injectors 13 in a conventional manner via an electronic control signal communicated via injector control lines 26, only one of which is shown. Likewise, in a similar manner, gas exchange valve actuators 30 are controlled in their operation via an electronic current signal carried by control communication line(s) 38. In most instances, the ECM actually controls current levels, duration and timing.

Electronic control module 15 could also be considered a portion of a pump output controller 19 that includes an electro hydraulic actuator 36 and a control communication line 18. Preferably, electro hydraulic actuator 36 controls the output of variable delivery pump 11 in proportion to the electronic current supplied via control communication line 18 in a conventional manner. For instance, in the preferred embodiment, electro hydraulic actuator 36 moves sleeves surrounding pistons in pump 11 to cover spill ports to adjust the affective stroke of the pump pistons. The pump output controller 19 could be analog, but preferably includes a digital control strategy that updates all values in the system at a suitable rate, such as every so many milliseconds. The pump control signal generated by electronic control module 15 is preferably a function of the desired rail pressure, the estimated rail pressure and the estimated consumption rate of the entire hydraulic system 10.

Figure 2:
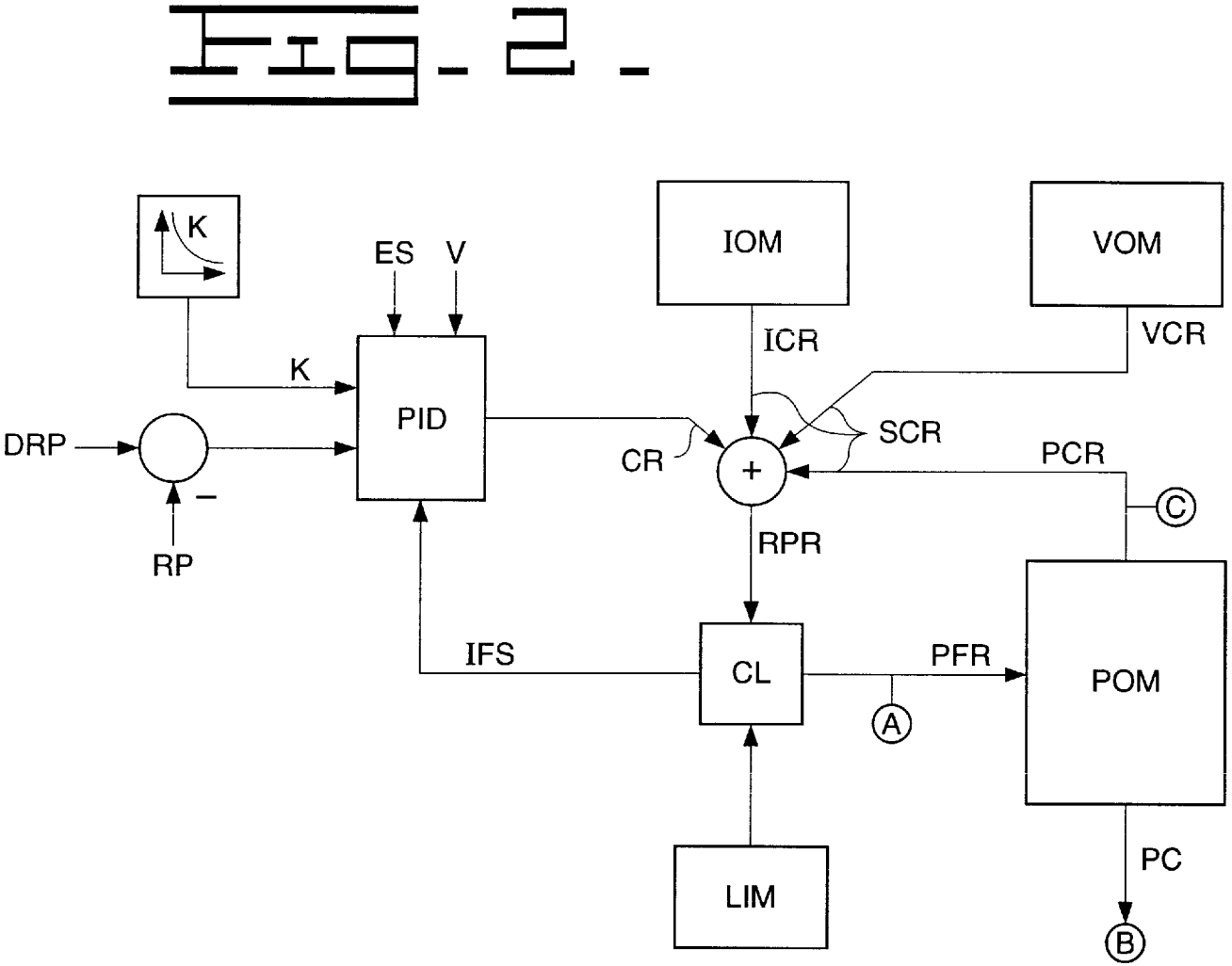
FIG. 2 is a flow diagram of the control strategy for the hydraulic system of FIG. 1.

Referring to FIG. 2, a flow diagram illustrates the preferred controlling strategy, which is preferably encoded in a suitable manner within electronic control module 15. The overall strategy for controlling hydraulic system 10 contemplates the usage of one or more observer models in conjunction with a standard feedback controller, such as a proportional integrator derivative controller (PID). Those skilled in the art will recognize that any suitable controller could be used, including but not limited to lead-lag controllers, PI controllers, etc. The observer models can be of any suitable level of sophistication and preferably are used to estimate the liquid system consumption rate (SCR) of hydraulic system 10. In the preferred embodiment illustrated, the system consumption rate (SCR) is the sum of the injector consumption rate (ICR) generated by an injector observer model (IOM), a gas exchange valve consumption rate (VCR) generated by a valve observer model (VOM), and a pump consumption rate (PCR) generated by a pump observer model (POM). The system consumption rate (SCR) is combined with a control rate (CR) to generate a requested flow rate (RFR).

The controlled rate (CR) is generated by the proportional integrated derivative controller (PID) based upon a comparison of the desired rail pressure (DRP) to the estimated rail pressure (RP). In this preferred embodiment, the control rate (CR) is a function of a loop gain (K) that is a function of engine speed (ES) as well as the error signal generated by comparing the desired rail pressure (DRP) to the estimated rail pressure (RP). It should be noted that the loop gain (K) is preferably calculated as a function of engine speed (ES) in order to incorporate the insight into the control system that the pump delivery rate, and therefore its ability to correct errors, is a function of engine speed since the variable delivery pump 11 is preferably driven directly by the engine's crankshaft via a suitable mechanical linkage in a conventional manner. The various consumption rates (ICR, VCR, PCR and SCR), as well as the control rate are preferably carried through the system as variables proportional to some preferred volume per unit time related value, such as cubic centimeters per engine revolution. Other than loop gain (K), there are likely several other gains in the (PID) control. These other gains could be scheduled as a function of engine speed to eliminate the loop gain (K). Engine speed was identified as having a major effect on the loop gain of the system. The PID gains are preferably scheduled as a function of viscosity. To minimize map sizes, the loop gain is a function of engine speed instead of mapping all the gains as a function of engine speed. The loop gain (K) compensates for the effect of engine speed.

Those skilled in the art will recognize that, in almost all instances, the system consumption rate (SCR) will be many times larger than the control rate (CR). The reason for this is that the control system attempts to match the pump output rate to the system consumption rate through appropriate modeling of the hardware that makes up hydraulic system 10 in an open loop manner. The philosophy for the present control system is to only burden the feedback portion of the control system to produce the slight change in pump output necessary to adjust pressure in the common rail and to compensate for any small errors between the observer models and the actual hardware behavior in the hydraulic system. In other words, if the observer models were perfectly accurate in predicting the consumption rate of the system, then the control rate (CR) generated by the feedback portion of the controller would be driven to a virtually zero value. Thus, those skilled in the art will recognize that the present control strategy can greatly reduce the time lag of the system in maintaining an adequate supply of liquid to meet the consumption demands of the hardware while maintaining that liquid supply at desired pressure.

Reiterating, the system consumption rate (SCR) is combined with the control rate variable (CR) to generate a requested pump rate (RPR). Before commanding the pump to produce the requested pump rate (RPR) the present system preferably compares the requested pump flow rate to the maximum flow rate of the pump by undergoing a control limit (CL) comparison. The control limitor relies upon limits (LIM) that are stored as data in memory accessible to the electronic control module. The control limitor (CL) produces a pump flow requirement (PFR) that is equal to the lessor of the requested flow rate and the maximum flow rate for variable delivery pump 11 but always equal to or greater than zero. In addition, the control limitor (CL) generates an integrator freeze signal (IFS) that is fed to the proportional integrator controller (PID) in a conventional manner in order to keep the control rate (CR) from growing excessively large due to integrator windup when the requested flow is greater than what the pump can deliver. The freeze signal preferably should not go active under normal situations. In the preferred embodiment, the pump observer model is utilized to convert the pump flow requirement (PFR) into a pump current that is communicated to the electro hydraulic actuator 36 of pump 11 via control communication line 18 (FIG. 1). The pump current (PC) should adjust variable delivery pump 11 to produce pressurized liquid at the pump flow requirement (PFR).

Figure 3:
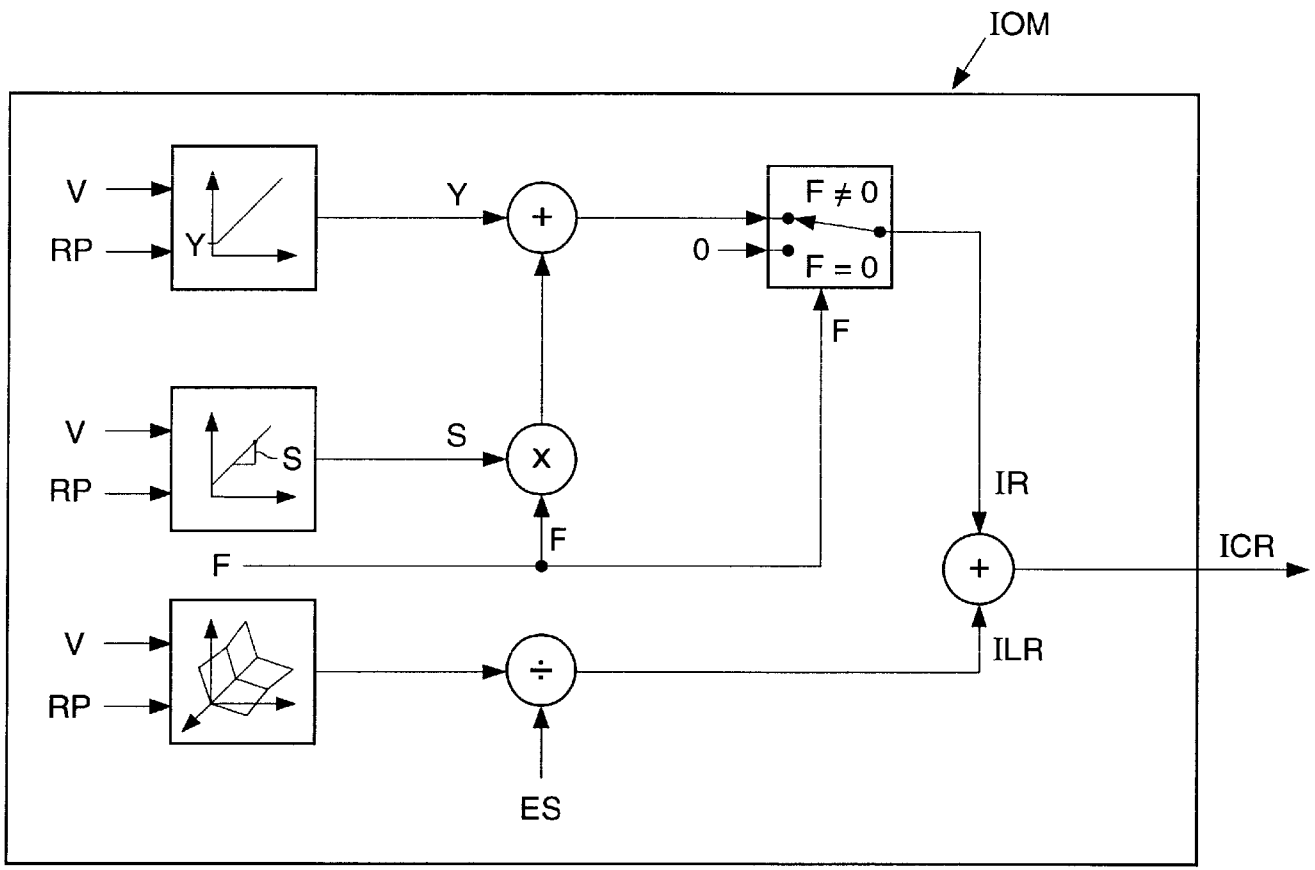
FIG. 3 is a flow diagram of the fuel injector observer model portion of the control strategy illustrated in FIG. 2.

Referring to FIG. 3 the preferred injector observer model (IOM) for the hydraulic system 10 shown in FIG. 1 is illustrated. Those skilled in the art will recognize that this injector observer model (IOM) assumes that fuel injectors 13 are hydraulically actuated fuel injectors that utilize a known quantity of pressurized oil in order to inject a known quantity of fuel. In the present case, this relationship is estimated as being linear. Nevertheless, those skilled in the art will appreciate that more sophisticated models could incorporate additional and possibly non-linear terms to account for the likely fact that the relationship between oil consumed and fuel injected is not exactly linear across the entire operating range of the fuel injector. However, more sophisticated models often require more computing power and more memory than might be justified by the increased accuracy. In this preferred injector observer model (IOM), the injector consumption rate (ICR) is a combination of an injector rate (IR), which represents the amount of oil consumed to inject a desired quantity of fuel, and an injector leakage rate (ILR) which represents a recognition that some high pressure oil will be consumed by the injector simply by leakage past the various movable components therein.

The injector observer model (IOM) recognizes that if the commanded quantity of fuel (F) is zero, then the injector rate (IR) is also set to zero. However, if the amount of fuel injected is greater than zero, the present invention preferably calculates an estimated linear relationship between the fuel quantity (F) and the oil consumed as a function of viscosity (V) and rail pressure (RP). Thus, this linear relationship includes a slope (S) and an intercept (Y). The intercept (Y) represents that threshold amount of oil that must be consumed by the injector at a given viscosity and rail pressure before any fuel is injected from fuel injector 13. For instance, the intercept (Y) generally could relate to the amount of pressurized oil consumed by the fuel injector in order to pressurize fuel above a valve opening pressure, which is related to the fuel supply pressure and the bulk modulus of the fuel. Since the estimated linear relationship between oil consumed and fuel injected is a function of both viscosity and rail pressure, the slope (S) is preferably calculated as a function of viscosity and rail pressure in a manner similar to the intercept (Y). The means by which the electronic control module calculates the slope (S) and the intercept (Y) can be accomplished in any suitable manner, such as by storing a multi-dimensional map in memory accessible to the electronic control module, or by storing a function that can generate these variables based upon the estimated viscosity and rail pressure. Those skilled in the art will appreciate that the portion of the injector observer model used to generate the injector rate (IR) could be substantially different for different types of fuel injectors, and could have any level of sophistication in order to produce a desired level of accuracy. For instance, in some fuel injection systems, such as the Bosch APCRS system identified earlier, an amount of actuation fluid (pressurized fuel) is continuously leaked throughout the injection event in order to control the opening and closing of the nozzle needle utilizing a pressure leakage control strategy. Thus, an injector observer model for other injector hardware might include a term related to the consumption rate of the injector attributed to the control thereof. Thus, the various observer models should correspond to the actual hardware utilized in the particular hydraulic system 10.

The injector observer model also preferably includes modeling to estimate the injector leakage rate (ILR). By being familiar with their own hardware, engineers can estimate the injector leakage rate at any desirable level of sophistication. For instance, in the preferred embodiment, a map or function stored in memory accessible to the electronic control module generates a leakage rate as a function of viscosity and rail pressure. This valve is then divided by the engine speed (ES) in order to generate an injector leakage rate (ILR) in units, such as cubic centimeters per engine revolution, that are identical to the units carried with the other rates generated by the system. Those skilled in the art will appreciate that the tradeoff of providing more computation power and memory storage for the electronic control module required by a more sophisticated injector observer model (IOM), such as by the inclusion of a leakage rate term (ILR) may not justify the additional accuracy produced by these more sophisticated modeling techniques. Those skilled in the art will recognize the inaccuracies in the observer models will be taken up by the feedback controller (PID) aspect of the control system. Thus, for a particular piece of injector hardware, if the leakage rate is also relatively small compared to the fluid consumption rate to inject fuel (IR) the additional accuracy brought by the leakage rate model may not be justified.

Figure 4:
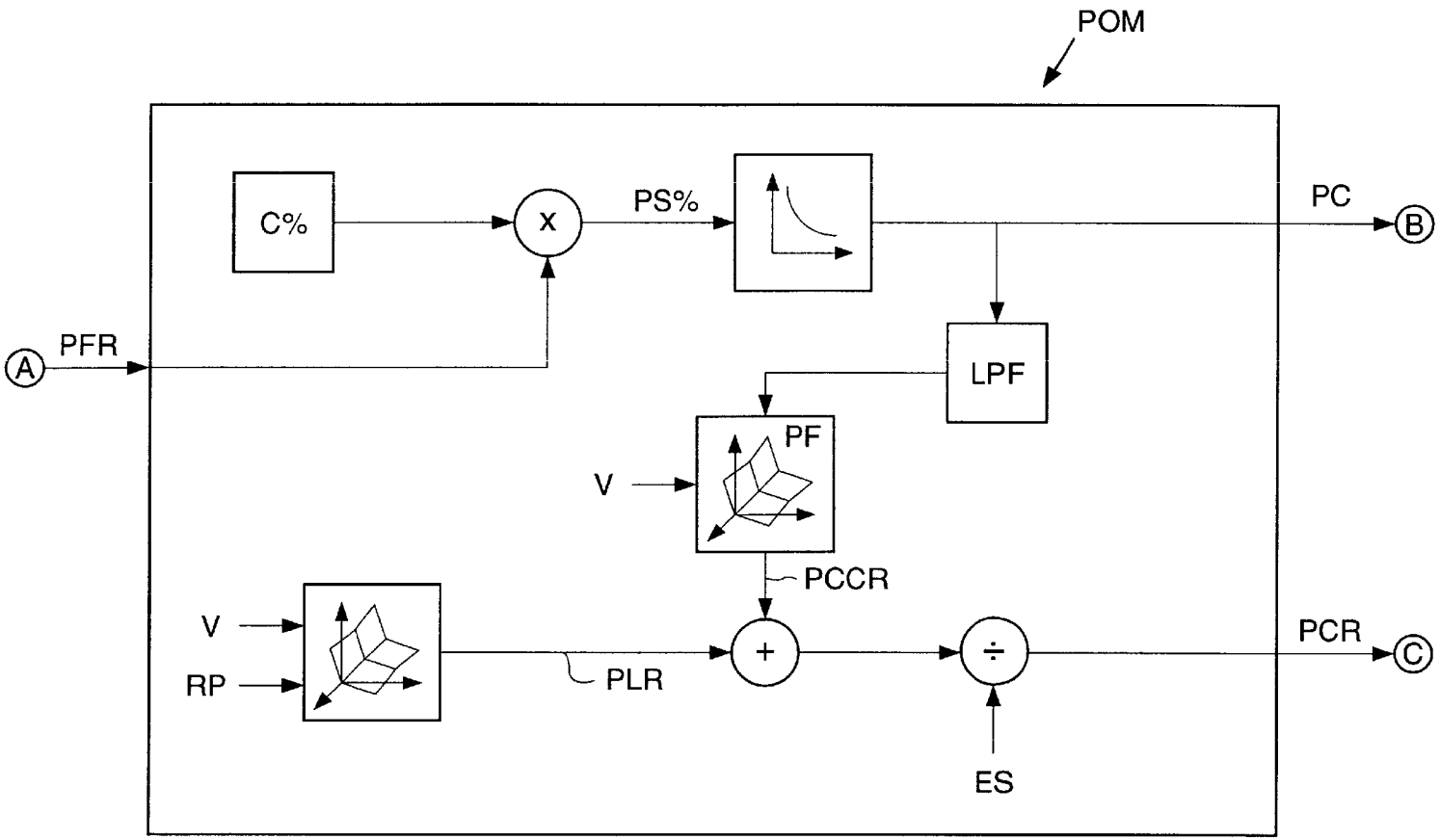
FIG. 4 is a flow diagram of a pump observer model portion of the control strategy illustrated in FIG. 2.

Referring to the pump observer model (POM) of, FIG. 4 the pump flow requirement (PFR) is multiplied by a constant (C%) to generate a pump stroke percentage (PS%). The pump stroke percentage (PS%) is converted through an appropriate function into pump current that corresponds to setting the pump output equal to the pump flow requirement (PFR). In the preferred hydraulic system illustrated in FIG. 1, the relationship between the pumping stroke percentage (PS%) and the pump current (PC) is preferably linear; however, the present invention recognizes that the correlation between the pump current (PC) and the pump flow requirement (PFR) may be something other than a linear relationship and the conversion of the pump stroke percentage (PS%) to the pump current (PC) can include whatever linear and/or nonlinear, etc. terms that are necessary for a desired level of accuracy.

In order to estimate the pump consumption rate (PCR), the present invention preferably recognizes that the amount of oil consumed by the pump is a combination of a pump leakage rate (PLR) and a pump controller consumption rate (PCCR). Those skilled in the art will recognize that the pump controller consumption rate (PCCR) is included because the preferred variable delivery pump 11 uses an electro hydraulic actuator 36 that necessarily consumes an amount of pressurized oil in order to adjust the position of the pump output control mechanism. The pump controller consumption rate (PCCR) is estimated by first passing the pump current (PC) through a low pass filter (LPF). Then, a look up table, map or appropriate function is used to estimate the amount of oil passing through the controller as a function of the pump current (PC) and the viscosity of the oil in the controller, which is preferably the same oil and viscosity used throughout hydraulic system 10. For variable delivery pumps that do not consume fluid in their controller, such as by a direct electronic controller, the PCCR term would be zero. In order to obtain the desired level of accuracy, the pump leakage rate (PLR) preferably utilizes a look up table, map or function of viscosity and rail pressure to estimate the leakage rate of the pump at a given operating condition. The pump leakage rate (PLR) and the pump controller consumption rate (PCCR) are combined and divided by the engine speed to generate a pump consumption rate (PCR) that is preferably in cubic centimeters per revolution, or otherwise in units similar to the other variables carried through the various calculations. Those skilled in the art will recognize that the engine speed (ES) term is used interchangeably with the pump rotation rate or the pump shaft rotation rate because in the preferred embodiment the pump shaft rotation rate is directly proportional to the engine speed.

Industrial Applicability

The present invention finds potential application in any hydraulic system, but is particularly applicable to hydraulic systems that include a common rail fuel injection system. When in operation, the pump output controller 19, which includes electronic controller module 15, preferably operates in a conventional digital manner at some suitable execution rate, such as every so many milliseconds or at some event rate such as firing rate. Thus, every fifteen milliseconds, electronic control module 15 updates its estimates of the rail pressure, the liquid temperature and the engine speed, which corresponds to the pump shaft rotation rate. In addition, other aspects of the electronic control module are utilizing other sensor inputs and user commands to determine the amount of fuel that is desired to be injected during a subsequent engine cycle. This desired amount of fuel and the operating condition of the engine generally determines what the desired rail pressure should be. Thus, the desired rail pressure is also preferably being updated during each computation cycle. Those skilled in the art will appreciate that not all aspects of the system need updating every computation cycle. Different parts of the model(s) can operate at different rates depending on the response of the system. In addition, each of the observer models calculates an estimated consumption rate for that piece of hardware at the same computational frequency. The system then combines the estimated system consumption rate with the control rate to arrive at a requested flow rate for the pump. This requested flow rate is then truncated in the event that it exceeds the maximum possible output rate for the pump. This pump flow rate is then converted into a pump control current that is used to adjust the position of the electro hydraulic controller 36 to make variable delivery pump 11 produce an output flow rate corresponding to the requested pump flow rate.

Those skilled in the art will appreciate that the present invention has been described in the example context of a Caterpillar Inc. type hydraulic fuel injection system. The present invention is also applicable to other types of common rail systems, such as the Bosch APCRS fuel system identified in "Heavy Duty Diesel Engines—The Potential of Injection Rate Shaping for Optimizing Emissions and Fuel Consumption", presented by Messrs. Bernd Mahr, Manfred Durnholz, Wilhelm Polach, and Hermann Grieshaber, Robert Bosch GmbH, Stuttgart, Germany, at the 21$^{st}$ International Engine Symposium, May 4–5, 2000, Vienna, Austria. In such a case, its injector observer model would preferably take into account an additional factor relating to the consumption rate of the direct control needle valve portion of that injection system. Furthermore, on such an alternative, the same fluid, namely diesel fuel, is used both as the hydraulic medium in the hydraulic system and as the injected medium into the engine's combustion space. The present invention also contemplates other types of pumps which might require modifications to the model described in relation to FIG. 4 in order to correspond properly to that particular hardware. For instance, in some cases the output controller for the pump may be purely electronic and therefore not consume any fluid from the hydraulic system. In other cases, the various leakage rates of the various devices that make up the hydraulic system could differ substantially from that illustrated in FIG. 1. Thus, the effectiveness of the present invention correlates strongly to the accuracy of any observer models in estimating the consumption rate of that particular piece of equipment based upon various sensor and other data. Those skilled in the art will also recognize that the observer models of the present invention can be made as accurate or as unsophisticated as each particular application demands. However, the more that the observer models are inaccurate, the more burden of maintaining proper pressure and fluid availability in the common rail falls to the feedback control aspect of the system.

While the described embodiment focuses in the context of an injection system, similar models would be preferably present for any other fluid consuming devices, including but not limited to gas exchange valves, EGR actuators, etc. While only current control has been described, the invention also contemplates other possible control methods, including but not limited to frequency, duty cycle, voltage, etc. Although the illustrated embodiment includes a pump driven directly by the engine, the invention contemplates other possibilities, such a fixed displacement pump driven by a variable speed motor. In such a case, the pump model and function would be significantly different, and may require a total flow rate with respect to time instead of engine revolutions.

Those skilled in the art will appreciate that that various modifications could be made to the illustrated embodiment without departing from the intended scope of the present invention. Thus, those skilled in the art will appreciate the other aspects, objects and advantages of this invention can be obtained from a study of the drawings, the disclosure and the appended claims.

What is claimed is:

1. A method of controlling a hydraulic system, comprising the steps of:

generating a control variable at least in part by comparing a desired liquid pressure to an estimated liquid pressure;

estimating a liquid consumption rate of the hydraulic system; and setting a pump output rate as a function of the control variable and the estimated system consumption rate.

2. The method of claim 1 wherein said setting step includes a step of summing said control variable and said estimated liquid consumption rate.

3. The method of claim 1 wherein the hydraulic system includes a plurality of fuel injectors; and said estimating step includes a step of estimating an injector consumption rate.

4. The method of claim 3 wherein said step of estimating an injector consumption rate includes a step of estimating an injector leakage rate.

5. The method of claim 1 wherein said estimating step includes a step of estimating a pump consumption rate.

6. The method of claim 5 wherein said step of estimating a pump consumption rate includes the steps of:

estimating a pump controller consumption rate;

estimating a pump leakage rate; and summing the estimated pump controller consumption rate and the estimated pump leakage rate.

7. The method of claim 1 including the steps of estimating a viscosity of the liquid in the hydraulic system; and estimating a pump shaft rotation rate.

8. The method of claim 1 wherein the hydraulic system includes at least one fuel injector and at least one other type of hydraulic device; and said estimating step includes the steps of:

estimating an injector consumption rate;

estimating a hydraulic device consumption rate; and summing the estimated injector consumption rate and the estimated hydraulic device consumption rate.

9. The method of claim 1 including a step of estimating a pump shaft rotation rate; and said generating step includes a step of calculating a loop gain that is a function of the estimated pump shaft rotation rate.

10. A method of controlling liquid pressure in a common rail hydraulic system for an engine, comprising the steps of:

estimating engine speed;

estimating a viscosity of a liquid in the hydraulic system;

estimating a rail pressure of the hydraulic system;

estimating an injector consumption rate;

estimating a pump consumption rate;

generating a control rate at least in part by comparing a desired rail pressure to an estimated rail pressure; and setting a pump output rate as a function of the control rate plus the estimated injector consumption rate plus the estimated pump consumption rate.

11. The method of claim 10 wherein said setting step includes a step of sending an electric signal to an electronic control portion of a variable delivery pump.

12. The method of claim 11 wherein said step of estimating an injector consumption rate includes the steps of:

estimating an injector leakage rate; and estimating an injector rate.

13. The method of claim 12 wherein said setting step includes the steps of:

determining a desired pump output rate; and setting the pump output rate to be the lesser of said desired pump output rate and a maximum pump output rate.

14. The method of claim 13 wherein said generating step includes a step of calculating a loop gain that is a function of the estimated engine speed.

15. The method of claim 14 wherein said step of estimating an injector consumption rate includes a step of calculating an injector oil consumption rate as a function of the estimated injector rate.

16. A common rail hydraulic system comprising:

a variable delivery pump with an outlet;

at least one hydraulic device with an inlet;

a common rail with an inlet fluidly connected to said outlet of said variable delivery pump, and an outlet connected to said inlet of said at least one hydraulic device; and a pump output controller operably coupled to said variable delivery pump, and producing a pump control signal that is a function of a desired rail pressure, an estimated rail pressure and an estimated consumption rate of the hydraulic system.

17. The system of claim 16 wherein said at least one hydraulic device includes a plurality of fuel injectors; and said variable delivery pump is a fixed displacement variable delivery axial piston pump.

18. The system of claim 17 wherein said variable delivery pump has an inlet connected to a source of low pressure oil; and said plurality of fuel injectors are hydraulically actuated fuel injectors.

19. The system of claim 18 wherein said pump output controller includes an electro-hydraulic actuator having a plurality of positions that are a function of an electric signal supplied to said pump output controller.

20. The system of claim 19 wherein said at least one hydraulic device includes at least one gas exchange valve actuator.

* * * * *